US006637689B1

(12) United States Patent
Vega

(10) Patent No.: US 6,637,689 B1
(45) Date of Patent: Oct. 28, 2003

(54) THREAD RESTRAINING DEVICE FOR BOBBINS

(76) Inventor: Carol Vega, 2450 W. 236th St., Torrance, CA (US) 90501

( * ) Notice: Subject to any disclaimer, the term of this patent is extended or adjusted under 35 U.S.C. 154(b) by 64 days.

(21) Appl. No.: 10/028,530

(22) Filed: Oct. 25, 2001

(51) Int. Cl.[7] ..... B65H 51/015; B65D 85/676

(52) U.S. Cl. ..... 242/172; 242/125.2; 242/125.3; 206/400

(58) Field of Search ..... 242/172, 170, 242/125.2, 125.3, 422.6; 206/398, 400

(56) References Cited

U.S. PATENT DOCUMENTS 397,999 A * 2/1889 Pratt ..... 242/125.3
1,392,910 A * 10/1921 Chase ..... 206/400
1,497,236 A * 6/1924 Happe ..... 206/400
1,923,456 A * 8/1933 Price ..... 206/400
2,932,388 A * 4/1960 Hartsfield et al. ..... 206/400
3,195,722 A * 7/1965 Duden ..... 206/400
5,246,185 A * 9/1993 Vincent ..... 242/125.3
5,449,128 A * 9/1995 Crisci, Jr. ..... 242/125.3
5,775,625 A * 7/1998 Shimomura ..... 242/422.6

* cited by examiner

*Primary Examiner*—Michael R. Mansen
(74) *Attorney, Agent, or Firm*—Goldstein & Lavas, P.C.

(57) ABSTRACT

A thread restraining device for bobbins including an elongated body portion having a generally rectangular configuration. The body portion has long opposed side edges, a first end, and a second end. The body portion has a plurality of linearly aligned apertures therethrough in a spaced relationship extending a length thereof. A locking protrusion extends outwardly of the first end of the body portion. The locking protrusion is engagable with one of the apertures once the body portion is disposed in a wrapped orientation.

2 Claims, 2 Drawing Sheets

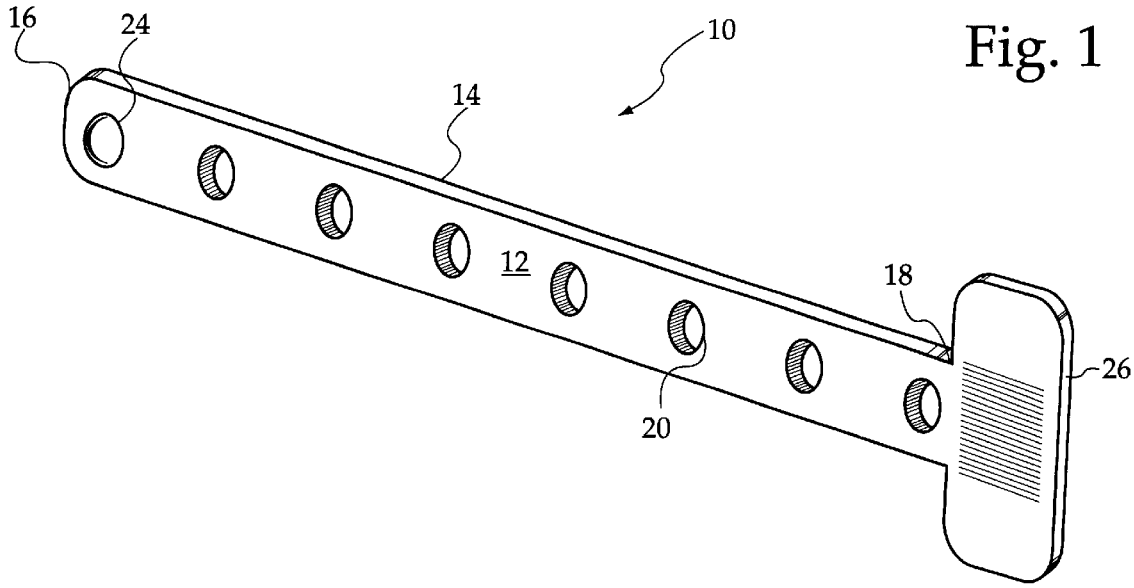
Fig. 1
Fig. 2
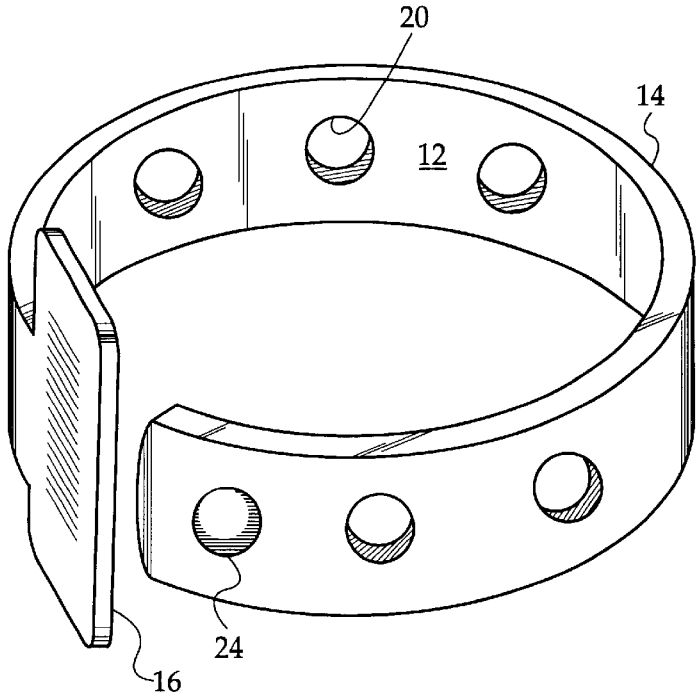

THREAD RESTRAINING DEVICE FOR BOBBINS

BACKGROUND OF THE INVENTION

The present invention relates to a thread restraining device for bobbins and more particularly pertains to preventing a bobbin from unwinding when not in use.

The use of sewing devices and accessories is known in the prior art. More specifically, sewing devices and accessories heretofore devised and utilized for the purpose of facilitating the sewing process are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,960,089 to Bogaert discloses a device for unwinding thread comprised of a bobbin with a sleeve to prevent loose turned and tangles. U.S. Pat. No. 2,690,726 to Wener discloses a bobbin brake assembly to prevent over running and backlash of thread. U.S. Pat. No. 2,555,658 to Ritter discloses a device for restraining the rotation of a bobbin to prevent over running.

While these devices fulfill their respective, particular objective and requirements, the aforementioned patents do not describe a thread restraining device for bobbins for preventing a bobbin from unwinding when not in use.

In this respect, the thread restraining device for bobbins according to the present invention substantially departs from the conventional concepts and designs of the prior art, and in doing so provides an apparatus primarily developed for the purpose of preventing a bobbin from unwinding when not in use.

Therefore, it can be appreciated that there exists a continuing need for a new and improved thread restraining device for bobbins which can be used for preventing a bobbin from unwinding when not in use. In this regard, the present invention substantially fulfills this need.

SUMMARY OF THE INVENTION

In the view of the foregoing disadvantages inherent in the known types of sewing devices and accessories now present in the prior art, the present invention provides an improved thread restraining device for bobbins. As such, the general purpose of the present invention, which will be described subsequently in greater detail, is to provide a new and improved thread restraining device for bobbins which has all the advantages of the prior art and none of the disadvantages.

To attain this, the present invention essentially comprises an elongated body portion having a generally rectangular configuration. The body portion has long opposed side edges, a first end, and a second end. The body portion has a plurality of linearly aligned apertures' therethrough in a spaced relationship extending a length thereof. A locking protrusion extends outwardly of the first end of the body portion. The locking protrusion is engagable with one of the apertures once the body portion is disposed in a wrapped orientation. A grasping tab is secured to and extends outwardly from the second end of the body portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved thread restraining device for bobbins which has all the advantages of the prior art sewing devices and accessories and none of the disadvantages.

It is another object of the present invention to provide a new and improved thread restraining device for bobbins which may be easily and efficiently manufactured and marketed.

It is a further object of the present invention to provide a new and improved thread restraining device for bobbins which is of durable and reliable construction.

An even further object of the present invention is to provide a new and improved thread restraining device for bobbins which is susceptible of a low cost of manufacture with regard to both materials and labor, and which accordingly is then susceptible of low prices of sale to the consuming public, thereby making such a thread restraining device for bobbins economically available to the buying public.

Even still another object of the present invention is to provide a new and improved thread restraining device for bobbins for preventing a bobbin from unwinding when not in use.

Lastly, it is an object of the present invention to provide a new and improved thread restraining device for bobbins including an elongated body portion having a generally rectangular configuration. The body portion has long opposed side edges, a first end, and a second end. The body portion has a plurality of linearly aligned apertures' therethrough in a spaced relationship extending a length thereof. A locking protrusion extends outwardly of the first end of the body portion. The locking protrusion is engagable with one of the apertures once the body portion is disposed in a wrapped orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the thread restraining device for bobbins constructed in accordance with the principles of the present invention.

FIG. 2 is a perspective view of the present invention illustrated in a wrapped orientation.

The same reference numerals refer to the same parts through the various figures.

DESCRIPTION OF THE PREFERRED EMBODIMENT

Figure 3:
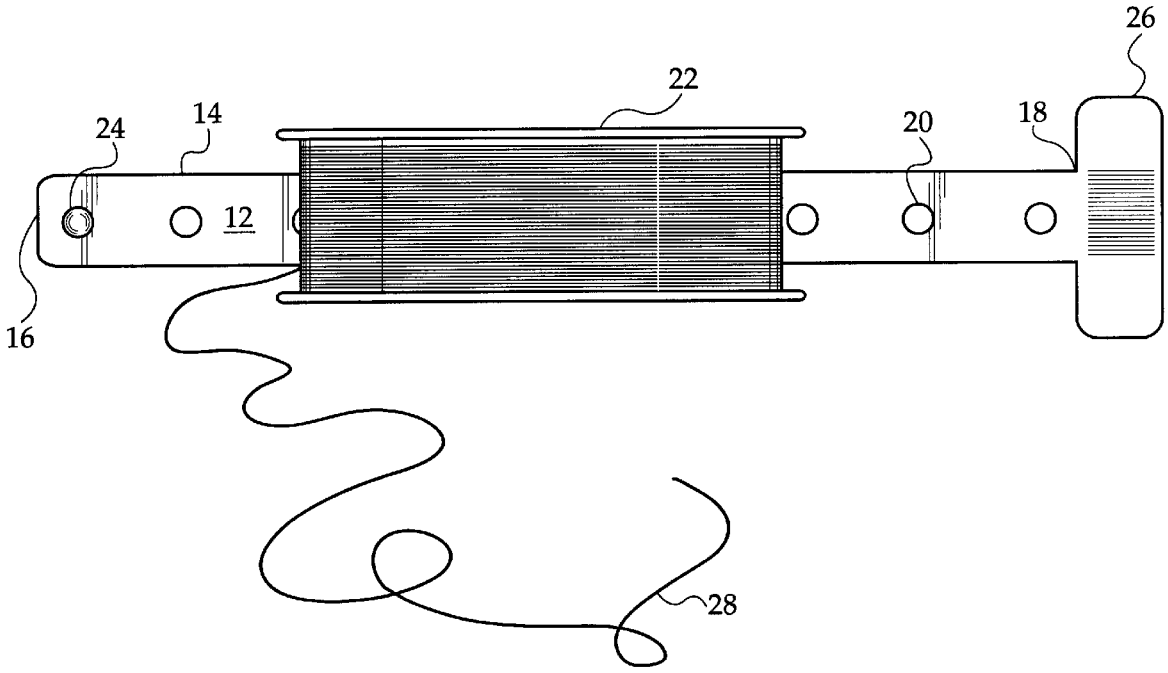
FIG. 3 is a side view of the present invention illustrated being positioned around a bobbin.
Figure 4:
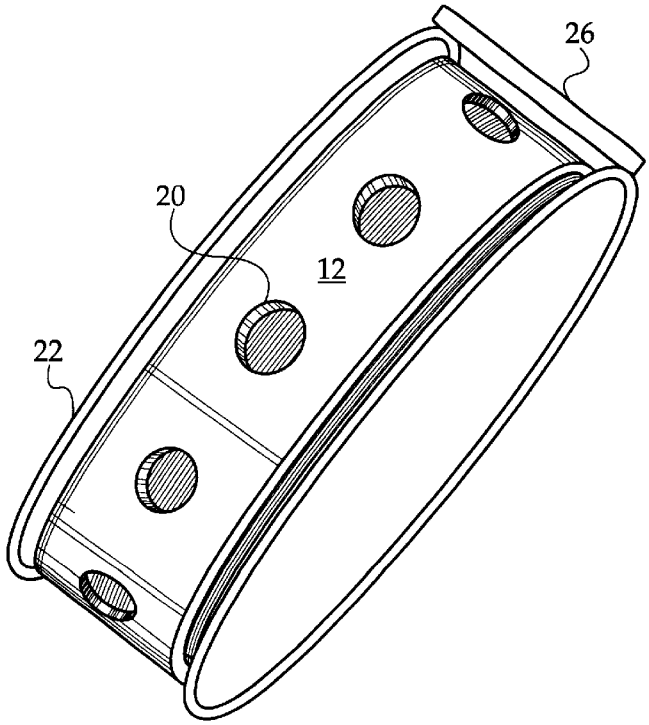
FIG. 4 is a perspective view of the present invention illustrated engaged to the bobbin.

With reference now to the drawings, and in particular, to FIGS. 1 through 4 thereof, the preferred embodiment of the new and improved thread restraining device for bobbins embodying the principles and concepts of the present invention and generally designated by the reference number 10 will be described.

Specifically, it will be noted in the various Figures that the device relates to a thread restraining device for bobbins for preventing a bobbin from unwinding when not in use. In its broadest context, the device consists of an elongated body portion, a locking protrusion, and a grasping tab. Such components are individually configured and correlated with respect to each other so as to attain the desired objective.

The elongated body portion 12 has a generally rectangular configuration. The body portion 12 has long opposed side edges 14, a first end 16, and a second end 18. The body portion 12 has a plurality of linearly aligned apertures 20 therethrough in a spaced relationship extending a length thereof. The body portion 12 is constructed of a flexible plastic to allow for its wrapping with respect to a bobbin 22.

The locking protrusion 24 extends outwardly of the first end 16 of the body portion 12. The locking protrusion 24 is engagable with one of the apertures 20 once the body portion 12 is disposed in a wrapped orientation.

The grasping tab 26 is secured to and extends outwardly from the second end 18 of the body portion 12.

In use, the present invention will prevent the inadvertent unwinding of thread 28 that is disposed around the bobbin 22. The first end 16 is positioned against the bobbin 22, and the body portion 12 is then wrapped around the bobbin 22 whereupon the protrusion 24 will be positioned through one of the apertures 20 whereby the main body 12 is wrapped snugly around the bobbin 22. By pulling outwardly on the grasping tab 26, the protrusion 24 will become disengaged from the aperture 20 allowing the main body 12 to be removed from the bobbin 22 and the thread unwrapped therefrom.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A thread restraining device for bobbins for preventing a bobbin from unwinding when not in use comprising, in combination:

an elongated body portion having long opposed side edges, a first end, and an opposed second end, the body portion having a plurality of linearly aligned apertures therethrough in a spaced relationship extending a length thereof;

a locking protrusion extending outwardly from the first end of the body portion, the locking protrusion being engagable with one of the apertures once the body portion is disposed in a wrapped orientation; and a grasping tab secured to and extending outwardly from the second end of the body portion.

2. The thread restraining device for bobbins as set forth in claim 1, wherein the body portion has a generally rectangular configuration.

* * * * *